US006084349A

United States Patent [19]

Ueoka et al.

[11] Patent Number: 6,084,349

[45] Date of Patent: Jul. 4, 2000

[54] HIGH-LUMINOUS INTENSITY HIGH-LUMINOUS EFFICIENCY PLASMA DISPLAY PANEL

[75] Inventors: Mitsuo Ueoka; Tetsuji Okajima, both of Tokyo, Japan

[73] Assignee: NEC Corporation, Tokyo, Japan

[21] Appl. No.: 09/027,213

[22] Filed: Feb. 20, 1998

[30] Foreign Application Priority Data

Feb. 20, 1997 [JP] Japan ..... 9-036272

[51] Int. Cl.[7] ..... H01J 11/02

[52] U.S. Cl. ..... 313/587; 313/112; 313/584; 313/585; 345/60; 345/80

[58] Field of Search ..... 313/584, 585, 313/586, 587, 112; 345/41, 65, 80

[56] References Cited

U.S. PATENT DOCUMENTS

| | | | |
|---|---|---|---|
| 5,541,479 | 7/1996 | Nagakubo | 313/587 X |
| 5,742,122 | 4/1998 | Amemiya et al. | 313/582 |
| 5,838,105 | 11/1998 | Mitomo | 313/587 X |

FOREIGN PATENT DOCUMENTS

| | | |
|---|---|---|
| 0 554 172 | 8/1993 | European Pat. Off. . |
| 0 782 167 | 7/1997 | European Pat. Off. . |
| 4-3693 | 2/1992 | Japan . |
| 4-245140 | 9/1992 | Japan . |
| 5-225911 | 9/1993 | Japan . |
| 7-21924 | 1/1995 | Japan . |
| 8-250029 | 9/1996 | Japan . |
| 8-315735 | 11/1996 | Japan . |

*Primary Examiner*—Ashok Patel

*Attorney, Agent, or Firm*—Sughrue, Mion, Zinn, Macpeak & Seas, PLLC

[57] ABSTRACT

A surface discharge alternating current plasma display panel has a pair of transparent electrodes supplied with current from metal bus electrodes through connecting portions spaced from each other by slits, a dielectric layer covering the pair of transparent electrodes and the metal bus electrodes and a porous insulating layer covering a part of the dielectric layer over the metal bus electrodes; when surface discharge occurs between the transparent electrodes of the pair, the surface discharge is spread toward the bus electrodes; however, the surface discharge can not exceed the slits; for this reason, the surface discharge is concentrated over the transparent electrodes.

18 Claims, 12 Drawing Sheets

HIGH-LUMINOUS INTENSITY HIGH-LUMINOUS EFFICIENCY PLASMA DISPLAY PANEL

FIELD OF THE INVENTION

This invention relates to a plasma display panel and, more particularly, to a high-luminous intensity high-luminous efficiency surface discharge alternating current plasma display panel.

DESCRIPTION OF THE RELATED ART

The plasma display panel radiates ultra-violet light through gas discharge, and the ultra-violet light excites a phosphor layer so as to generate visible light. When the ultra-violet light selectively excites the phosphor layer, the visible light forms an image on the screen. The gas discharge takes place due to either alternating or direct current, and, accordingly, the plasma display units are divided into two groups. The alternating current plasma display panel is superior to the direct current plasma display panel in luminous intensity, luminous efficiency and durability. In particular, a reflecting type alternating current plasma display panel is superior in these characteristics.

FIG. 1 illustrates a typical example of the reflecting type alternating current plasma display panel. The prior art reflecting type alternating current plasma display panel largely comprises a front side substrate structure 1 and a backside substrate structure 2. The front side substrate structure 1 is spaced from the backside substrate structure 2, and discharge gas fills the gap between the front side substrate structure 1 and the backside substrate structure 2.

The front side substrate structure 1 includes a transparent front side substrate 1*a,* discharge electrodes 1*b* arranged on an inner surface of the front side substrate 1*a* and a transparent dielectric layer 1*c* covering the discharge electrodes 1*b*. The transparent dielectric layer 1*c* is covered with a protective layer (not shown) of magnesium oxide, and ranges from 0.5 micron to 1 micron thickness. The protective layer decreases the discharge voltage, and prevents the transparent dielectric layer 1*c* from sputtering during firing. The discharge electrodes 1*b* extend in the direction perpendicular to the paper where FIG. 1 is drawn. Each of the discharge electrodes 1*b* is implemented by a transparent electrode 1*d* and a bus electrode 1*e* laminated on the transparent electrode 1*d*. The bus electrode 1*e* is narrower than the transparent electrode 1*d,* and a part of the transparent electrode 1*d* is covered with the bus electrode 1*e*. The discharge electrode 1*b* is spaced from adjacent discharge electrodes 1*b,* and discharging gap 1*f* takes place therebetween.

On the other hand, the back side substrate structure 2 includes a back side substrate 2*a,* data electrodes 2*b* arranged on the inner surface of the back side substrate 2*a,* a white dielectric layer 2*c* covering the data electrodes 2*b* and a phosphor layer 2*d* laminated on the white dielectric layer 2*c*. The data electrodes 2*b* extend in a perpendicular direction to the discharge electrodes 1*b*. Though not shown in FIG. 1, partition walls are formed on the white dielectric layer 2*c,* and extend in parallel to the data electrodes 2*b* so as to define discharge cells 3. The partition walls prevent the discharge cells 3 from mis-firing and cross-talk. The upper surfaces of the partition walls are colored black, and the black anti-reflection layer is effective against the reflection of incident light passing through the front side substrate 1*a*.

The electrodes 1*d* are expected not to be formed of transparent material such as stannic oxide ($SnO_2$) or indium-tin-oxide (ITO). The transparent material is not small in sheet resistance. When the prior art plasma display panel is designed to have a wide screen or a high-resolution screen, the pulse signal encounters large resistance of the order of tens kilo-ohms on the discharge electrodes 1*b,* and hardly fires some discharge cells at the ends of the discharge electrodes 1*b*. In order to decrease the resistance along the discharge electrodes 2*b,* a thin composite film of chromium/copper/chromium or a thin aluminum film forms a part of the transparent electrode 1*d,* or a thick silver film is used as the bus electrode 1*e*.

The transparent dielectric layer 1*c* covers the discharge electrodes 1*b,* and sets a limit on the amount of current. The transparent dielectric layer 1*c* is formed of paste mainly composed of low-melting point flint glass. The low-melting point flint glass provides large withstand voltage to the dielectric layer 1*c,* and is easily formed into a predetermined configuration. The discharge electrodes 1*b* and the exposed inner surface of the front side substrate 1*a* are coated with the paste, and the paste layer is fired at a certain temperature higher than the softening point of the flint glass. The paste is reflowed during the firing, and forms the smooth transparent dielectric layer 1*c* which is 20 microns to 40 microns thick without bubbles.

As described hereinbefore, the transparent dielectric layer 1*c* is covered with a protective layer (not shown), and a thin film of magnesium oxide or a thick film of magnesium oxide serves as the protective layer. The protective layer ranges from 0.5 micron to 1 micron thick. The thin film of magnesium oxide is formed through an evaporation or a sputtering, and the thick film of magnesium oxide is formed through a printing process or a spraying technique. The protective layer decreases the discharge voltage, and prevents the dielectric layer 1*c* from sputtering during the firing.

On the other hand, low-melting point flint glass and white pigment are mixed into paste. Typical examples of the white pigment are titanium oxide powder and alumina powder. The paste is printed over the data electrodes 2*b,* and the paste layer is fired so as to form the white dielectric layer 1*c*.

Paste is printed on the white dielectric layer 2*c* for the partition walls. Metal oxide powder such as iron, chromium or nickel is mixed with the low-melting point glass so as to form paste, and the paste is printed on the upper surfaces of the partition walls. When the paste is fired, the metal oxide powder colors the upper surfaces of the partition walls.

The phosphor layer 2*d* is colored into the three primary colors, i.e., red, green and blue. The three primary colors are screen printed, respectively, and both side surfaces are further colored into the three primary colors so as to increase the colored area. The increased colored area enhances the luminous intensity.

When the front side substrate structure 1 and the back side substrate structure 2 are completed, the front side substrate structure 1 is opposed to the back side substrate structure 2 in such a manner as to make the discharge electrodes 1*b* perpendicular to the data electrodes 2*b,* and are bonded through the partition walls to one another. The discharge gas is sealed into the gap between the front side substrate structure 1 and the back side substrate structure 2 at 500 torr. The discharge gas is, by way of example, gaseous mixture of He, Ne and Xe.

Each of the discharge cells 3 is defined by adjacent two discharge electrodes 1*b*. A pulse signal at tens KHz to hundreds KHz is alternately applied between the adjacent discharge electrodes 1*b,* and the surface discharge selectively takes place in the discharge cells 3. Plasma is generated in the selected discharge cells 3, and ultra-violet light is radiated onto the phosphor layer 2*d*. The ultra-violet light excites the phosphor layer 2*d* colored into the three primary colors, and the visible light is radiated from the phosphor layer 2*d* through the front side substrate structure 1 to the outside.

The adjacent two discharge electrodes 1*b* serve as a scanning electrode and a sustain electrode. In order to select the discharge cells to be fired, a potential is selectively applied between the scanning electrodes and the data electrodes 2*b*, and the pulse signal is repeatedly applied between the scanning electrode and the sustain electrode so as to continue the surface discharge.

One of the technical goals of the surface discharge plasma display panel is high luminous intensity, and another is high luminous efficiency or low power consumption. Yet another technical goal is to restrict undesirable reflection of incident light. In order to achieve this technical goals, the following improvements have been proposed. In the following description, the prior art surface discharge alternating current plasma display panel shown in FIG. 1 is referred to as "basic plasma display panel".

Two prior art surface discharge plasma display panels are hereinbelow introduced, and both aim at improvement of the luminous efficiency. The first prior art surface discharge plasma display panel is disclosed in Japanese Patent Publication of Unexamined Application No. 8-250029, which is a modification of the basic plasma display panel. The first prior art surface discharge plasma display panel is different from the basic plasma display panel in that the dielectric layer 2*c* is partially increased in thickness. In detail, the bus electrode 1*e* is offset from the center line of the associated transparent electrode 1*d* toward the opposite side to the edge defining the discharging gap 1*f* as similar to the bus electrode 1*e* shown in FIG. 1, and the transparent dielectric layer 1*c* over the bus electrode 1*e* is thicker than the remaining portion between the discharging gap 1*f* and the bus electrode 1*e*. The thick portions limit the surface discharge between the discharging gap and the bus electrodes 1*e*, and the first prior art surface discharge plasma display panel is expected to achieve high luminous efficiency and low power consumption.

However, the first prior art surface discharge plasma display panel can not achieve the high luminous intensity. The low luminous intensity is derived from recombination of ion and electron on the surface of the thick portions. This phenomenon is analogous to a dielectric body inserted into a discharging space. Moreover, the manufacturer can not sufficiently increase the thickness of the thick portions, because the flint glass flows from the thick portions to the remaining portion during the reflow. The reflow is indispensable because of the evacuation of bubbles from the dielectric layer 2*c*. Thus, the thick portions tend to be thinner than the target thickness, and the surface discharge is broadened beyond the limit created by the thick portions. As a result, the first prior art surface discharge plasma display panel can not decrease the electric power consumption to the extent to be expected.

The second prior art surface discharge plasma display panel is disclosed in Japanese Patent Publication of Unexamined Application No. 8-315735. The second prior art surface discharge plasma display panel has discharging electrodes with the laminated structure as similar to the discharging electrodes 1*b* of the basic plasma display panel. The discharging electrode is divided into sub-electrodes, and the sub-electrodes start the surface discharge at different timings. The timing control employed in the second prior art surface discharge plasma display panel effectively reduces the peak current. However, it is not effective against discharge loss, and the luminous efficiency is not improved. Thus, both first and second prior art surface discharge plasma display panels can not achieve high luminous efficiency.

Two prior art surface discharge plasma display panels are further introduced hereinbelow. The third to fourth prior art surface discharge plasma display panels aim at reduction of the reflection without sacrifice of luminous intensity. The basic plasma display panel restricts the reflection of incident light by coating the upper surface of the partition wall with the black anti-reflection layer, because the reflection of incident light is undesirable for the contrast on the screen. For this reason, it is necessary to restrict the reflection of incident light without reduction of the luminous intensity of the visible light radiated from the discharge cells.

In order to achieve this technical goal, a color filter 4 is provided in the plasma display panel as shown in FIG. 2. The other components are labeled with the same references designating corresponding components of the basic plasma display panel without detailed description for the sake of simplicity. The color filter 4 is selectively colored in the three primary colors, and, accordingly, has red areas, blue areas and green areas. The red area, the blue area, and the green area respectively pass red light, blue light and green light radiated from the discharge cells 3. The color filter 4 is laminated on the front side substrate structure 1 as shown in FIG. 2, or the transparent dielectric layer 1*c* is colored so as to serve as the color filter 4.

A typical example of the colored semi-transparent dielectric layer 1*c* is disclosed in Japanese Patent Publication of Unexamined Application No. 4-36930, and the plasma display panel disclosed therein is hereinbelow referred to as "third prior art surface discharge plasma display panel". The Japanese Patent Publication of Unexamined Application proposes to form the colored semi-transparent dielectric layer 1*c* as follows. Three kinds of filter paste are first prepared. Three kinds of pigment for the three colors are individually mixed with low-melting point flint glass, binder and organic solvent. Then, the three kinds of filter paste are obtained. The three kinds of filter paste are separately screen printed over the inner surface of the front side transparent substrate and the discharge electrodes 1*b*. In other words, the screen printing is three times repeated for the three primary colors. As a result, the red areas, the red filter paste, the blue filter paste and the green filter paste form the red paste areas, the blue paste areas and the green paste areas, and boundaries occur between the red paste areas, the blue paste areas and the green paste areas.

The filter paste is sintered or fired so as to form the colored semi-transparent dielectric layer 1*c*. The three kinds of pigment are required to withstand a high-temperature sintering process at 500 degrees to 600 degrees in centigrade, and, for this reason, the three kinds of pigment are selected from inorganic materials. Typical examples are as follows.

Pigment for red color: $Fe_2O_3$ system

Pigment for blue color: $CoO$-$Al_2O_3$ system

Pigment for green color: $CoO$-$Al_2O_3$-$Cr_2O_3$ system

The colored semi-transparent dielectric layer 1*c* is simple. However, when the screen printing is repeated three times, the red paste areas, the blue paste areas and the green paste areas are liable to be slightly separated and/or partially overlapped with one another, and gaps and steps occur along the boundaries between the red areas, the blue areas and the green areas. The gaps and the steps are causative of dielectric breakdown, and have undesirable influence on the formation of the black anti-reflection layer. Thus, the third prior art surface discharge plasma discharge panel encounters a problem in flatness of the colored semi-transparent dielectric layer 1*c*.

Japanese Patent Publication of Unexamined Application No. 7-21924 proposes a solution of the problem inherent in the third prior art surface discharge plasma discharge panel. The plasma discharge panel disclosed in Japanese Patent Publication of Unexamined Application No. 7-21924 is hereinbelow referred to as "fourth prior art surface discharge plasma display panel". The inner surface of the front side substrate and the discharge electrodes 1*b* are covered with the paste layers for the three primary colors, similar to the third prior art surface discharge plasma display panel, and the paste layers are covered with a low melting point flint glass paste layer. The paste layers for the three primary colors and the low melting point flint glass paste layer are sintered so as to form the colored semi-transparent dielectric layer 1*c* covered with the low melting point flint glass layer. The low melting point flint glass layer creates a smooth surface in spite of the gaps and the steps. Thus, the fourth prior art surface discharge plasma display panel solves the problem inherent in the third prior art surface discharge plasma display panel. However, the colored semi-transparent dielectric layer covered with the low melting point flint glass layer encounters serious reduction in the luminous intensity.

In detail, the pigment has a different refractive index than the low melting point flint glass layer, and the colored semi-transparent dielectric layer scatters the incident light. This results in a reduction in transmittance of parallel rays. The transmittance of parallel rays represents the ratio of the luminous intensity between parallel incident light and parallel transmission light, and the scattered light is omitted. When external light is incident upon the colored semi-transparent dielectric layer, back scattering takes place, and whitens the screen. Moreover, a black image is affected by the reflected light on the colored area, such that the user finds the black image unusual. The light emitted from the discharge cells is also affected by the colored semi-transparent dielectric layer, and the luminous intensity is decreased.

If a thin color filter containing inorganic pigment particles is laminated on the front side substrate structure as shown in FIG. 2, the luminous intensity is improved relative to the fourth prior art surface discharge plasma display panel. However, the thin color filter over the bus electrodes 1*e* makes the withstand voltage of the transparent dielectric layer 1*c* low, and the transparent dielectric layer 1*c* is liable to be broken down during the discharge. This results an imperfect image produced on the screen. Moreover, the breakdown of the transparent dielectric layer 1*c* gives rise to increased discharge voltages, and the bus electrodes 1*e* are split into pieces.

In order to prevent the transparent dielectric layer 1*c* from breaking down, the transparent dielectric layer 1*c* may be partially increased in thickness over the bus electrodes 1*e*. The transparent dielectric layer 1*c* is usually formed of the low melting point flint glass, and the large dielectric constant makes the discharge voltage low. If the transparent dielectric layer 1*c* is increased to at least 30 microns, the thick transparent dielectric layer 1*c* can eliminate the surface discharge from the bus electrodes 1*e*. However, the reflow process does not allow the transparent dielectric layer to be thick enough to prevent the bus electrodes 1*e* from the surface discharge. For this reason, although the color filter improves the luminous intensity, the prior art surface discharge plasma discharge panel with the color filter suffers from poor durability.

In summary, the thick portion proposed in first prior art surface discharge plasma display panel fairly improves the luminous intensity. However, the thick portion is not effective against the low luminous efficiency, and is not reproducible due to the reflow. The discharge sub-electrodes proposed in the second prior art surface discharge plasma display panel decrease the peak value of the discharge current. However, the discharge sub-electrodes are not effective against the power consumption, and the second prior art surface discharge plasma display panel is not improved in luminous efficiency. Both first and second prior art surface discharge plasma display panels hardly form a high-resolution wide display area.

The color filters proposed in the third prior art surface discharge plasma display panel improves the contrast. However, the color filers suffer from dielectric breakdown. Although the transparent dielectric layer over the filters is effective against dielectric breakdown, the luminous intensity is decreased.

SUMMARY OF THE INVENTION

It is therefore an important object of the present invention to provide a plasma display panel, which achieves high luminous intensity, high luminous efficiency and good reproducibility.

In accordance with one aspect of the present invention, there is provided a plasma display panel comprising a back substrate structure having a first substrate and a plurality of data electrodes formed on an inner surface of the first substrate, a front substrate structure having a second substrate, a plurality of transparent electrodes formed on an inner surface of the second substrate, a plurality of bus electrodes formed over the inner surface of the second substrate and electrically connected to the plurality of transparent electrodes so as to selectively discharge electric current from the plurality of transparent electrodes and a plurality of stopper means electrically connected between the plurality of transparent electrodes and the plurality of bus electrodes and protecting the plurality of bus electrodes from the discharge at the plurality of transparent electrodes, and discharging gas sealed between the back substrate structure and the front substrate structure for producing plasma.

BRIEF DESCRIPTION OF THE DRAWINGS

The features and advantages of the plasma display panel will be more clearly understood from the following description taken in conjunction with the accompanying drawings in which.

DESCRIPTION OF THE PREFERRED EMBODIMENTS

First Embodiment

Figure 3:
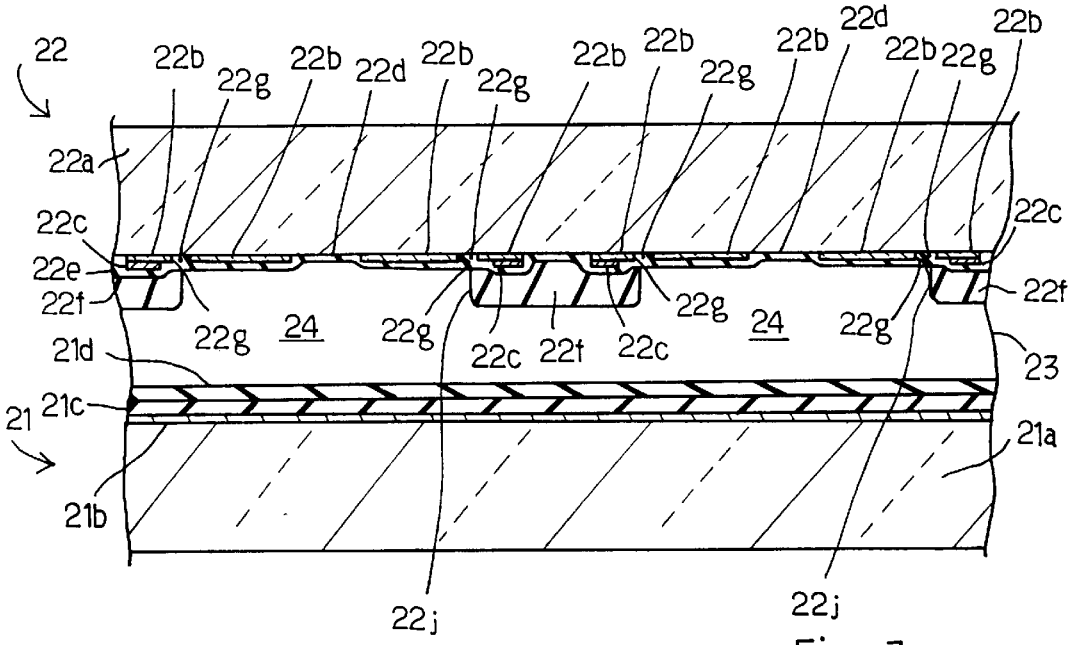
FIG. 3 is a cross sectional view showing the structure of a plasma display panel according to the present invention.

Referring to FIG. 3 of the drawings, a surface discharge alternating current plasma display panel embodying the present invention largely comprises a back substrate structure 21, a front substrate structure 22 and discharge gas 23 sealed in gap between the back substrate structure 21 and the front substrate structure 22. A display area is formed on the front substrate structure 22, and the surface discharge alternating current plasma display panel forms an image on the display area.

The back substrate structure 21 includes a glass substrate 21*a,* a plurality of data electrodes 21*b* extending in parallel on the glass substrate 21*a,* a white dielectric layer 21*c* covering the data electrodes 21*b* partition walls (not shown) patterned on the white dielectric layer 21*c* and a phosphor layer 21*d* covering the white dielectric layer 21*c.* The partition walls are arranged in parallel in a perpendicular direction to the data electrodes 21*b* at 350 micron pitch, and are 80 microns in width. The partition walls are positioned between the data electrodes 21*b,* and are not shown in FIG. 3. The phosphor layer 21*d* is suitably colored.

On the other hand, the front substrate structure 22 includes a transparent glass substrate 22*a,* a plurality of transparent electrodes 22*b* formed on the inner surface of the transparent glass substrate 22*a* and metal bus electrodes 22*c* laminated on the transparent electrodes 22*b.* The transparent electrodes 22*b* are spaced from the adjacent transparent electrodes 22*b,* and discharge gap 22*d* therebetween. The metal bus electrode 22*c* is disposed on the side periphery of the transparent electrode 22*b* opposite to the discharge gap 22*d.* The transparent electrodes 22*b* and the data electrodes 22*c* define discharging cells 24.

The front substrate structure 22 further includes a transparent dielectric layer 22*e* covering the electrode pairs 22*d.* The transparent dielectric layer 22*e* does not contain bubbles, and is 25 microns thick. The transparent dielectric layer 22*e* is formed as follows. Low melting point glass paste is screen printed over the electrode pairs 22*d,* and is sintered around 570 degrees in centigrade so as to form the transparent dielectric layer 22*e.* The transparent glass is reflowed during the sintering, and bubbles are evacuated from the transparent dielectric layer 22*e.*

The front substrate structure 22 further includes a porous dielectric layer 22*f* formed on the lower surface of the transparent dielectric layer 22*e.* The porous dielectric layer 22*f* range from 5 microns to 50 microns thick. The thickness of the porous dielectric layer 22*f* preferably ranges between 5 microns to 20 microns.

The porous dielectric layer 22*f* is formed through the following process. First, aluminum oxide powder and/or magnesium oxide powder is mixed with low-melting point lead glass powder, binder and solvent so as to produce dielectric paste. The powdery mixture, i.e., the mixture between the aluminum oxide/magnesium oxide powder and the low-melting point lead glass powder contains aluminum oxide powder and/or magnesium oxide powder between 10 weight percent to 50 weight percent. When the low-melting point lead glass powder exceeds 90 weight percent, the dielectric layer 22*f* becomes dense, and the porosity is improper for the porous dielectric layer 22*f.* On the other hand, if the low-melting point lead glass powder is less than 50 weight percent, the porous dielectric layer 22*f* become brittle, and is liable to be broken during the assembling work between the front substrate structure 22 and the back substrate structure 21.

The dielectric paste is patterned on the transparent dielectric layer 22*e* by using a thick-film printing technique, and the discharging cell 24 is encircled with the dielectric paste pattern. When the manufacturer colors the dielectric layer 22*f,* the inorganic pigment is added to the powdery mixture, or part of the aluminum oxide/magnesium oxide powder is replaced with the inorganic pigment.

The dielectric paste is sintered between 480 degrees to 550 degrees in centigrade, and is formed into the dielectric layer 22*f.* The sintering temperature is lower than the reflowed temperature of the transparent dielectric layer 22*e.* For this reason, the low-melting point lead glass of the powdery mixture is equal in softening temperature to the low-melting point glass for the transparent dielectric layer 22*e,* or is at least 30 degrees lower than it.

In this instance, black inorganic pigment is further mixed into the dielectric paste, and the porous dielectric layer 22*f* is black. The black porous dielectric layer prohibits incident light from reflection, and improves the contrast of an image formed on the display area.

Though not shown in FIG. 3, magnesium oxide is deposited over the entire surface of resultant structure, i.e., the dielectric layer 22*f* and the transparent dielectric layers 22*e* by using a vacuum evaporation technique, and the porous dielectric layer 22*f* and the transparent dielectric layer 22*e* are covered with a magnesium oxide layer. When the front substrate structure 22 is assembled with the back substrate structure 21, the peripheral area is assigned to a spacer (not shown) for bonding the front substrate structure 22 to the back substrate structure 21, and the magnesium oxide layer is an obstacle. For this reason, the peripheral area is masked during the vacuum evaporation.

After the assemblage between the front substrate structure 22 and the back substrate structure 21, the discharging gas is sealed in the gap between the front substrate structure 22 and the back substrate structure 21.

Figure 4:
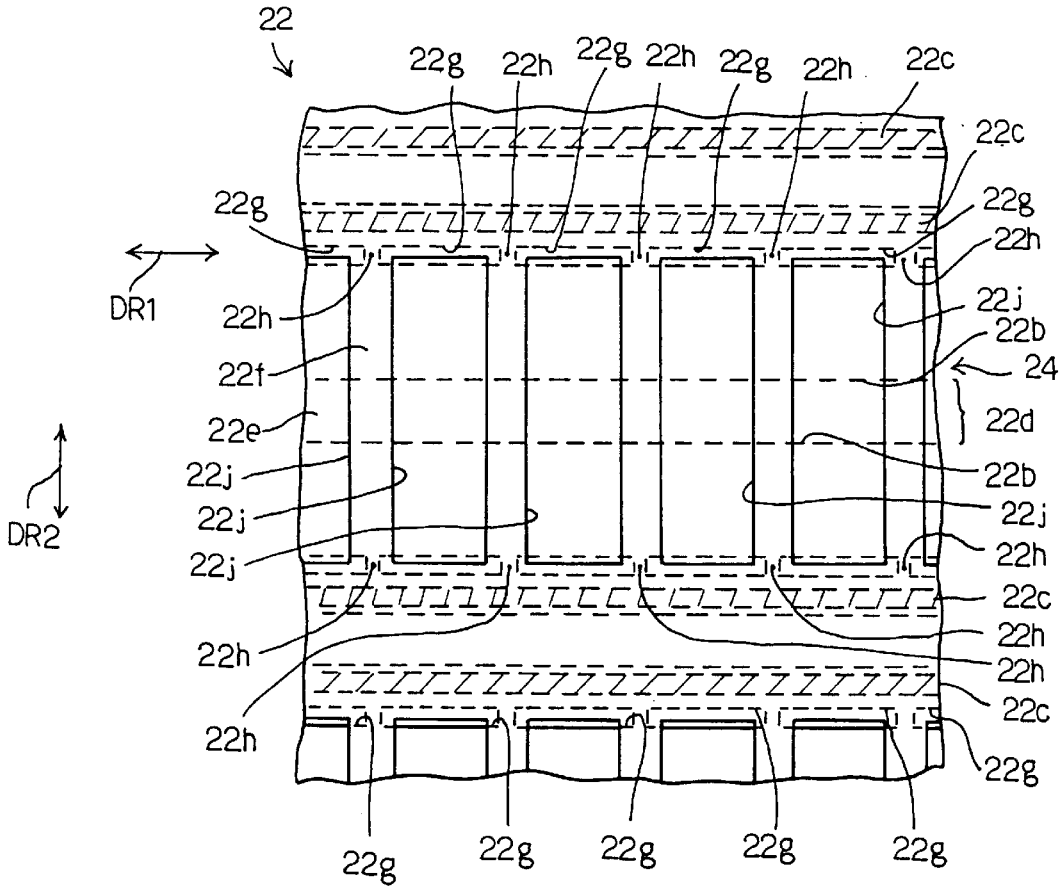
FIG. 4 is a bottom view showing slits formed in transparent electrodes.

Slits 22*g* are formed in the transparent electrodes 22*b* as shown in FIG. 4. The slits 22*g* have width ranging from 10 microns to 100 microns and, preferably, of the order of 50 microns. The slits 22*g* are elongated in a direction DR1 parallel to the discharge gap 22*d,* and are arranged at intervals. The slits 22*g* are closer to the metal bus electrodes 22*c* than to the discharge gap 22*d,* and connecting portions 22*h* are narrowed by the slits 22*g*. The metal bus electrodes 22*c* are hatched in FIGS. 4 and 5 so as to be easily discriminated from the transparent electrodes 22*b*. Rectangular openings 22*j* are formed in the porous dielectric layer 22*f*, and are located under the transparent electrodes 22*b* opposed to each other through the discharge gap 22*d*. The rectangular openings 22*j* form a row, and the row of rectangular openings 22*j* is repeated in a direction DR2 perpendicular to the discharge gap 22*d*. Thus, the rectangular openings 22*j* form a porous dielectric layer lattice-like configuration. The lattice-like pattern is repeated in the direction DR2 at 350 micron pitch, and has width of the order of 80 microns. On the other hand, the lattice-like pattern is repeated in the direction DR1 at 1050 micron pitch, and has width ranging from 200 microns to 400 microns. The connecting portions 22*h* and the slits 22*g* as a whole constitute a stopper means. The porous dielectric layer 22*f* covers the periphery of each of the discharge cells 24 assigned to red light, green light or blue light, and the associated metal bus electrodes 22*c* are electrically connected to the pair of transparent electrodes 22*c* through the connecting portions 22*h* at the four corners of the pair of transparent electrodes 22*c*.

Figure 5:
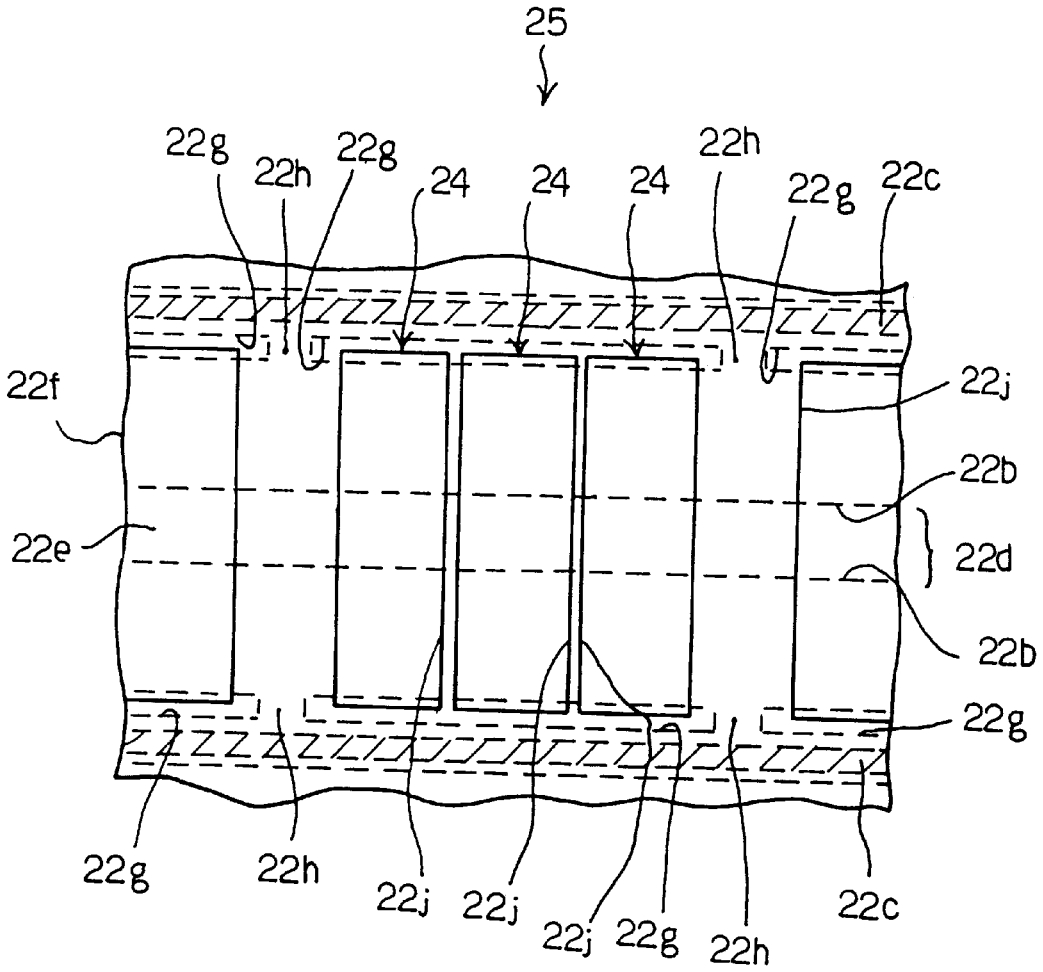
FIG. 5 is a bottom view showing a modification of the front substrate structure.

The discharge cells 24 assigned to the red light, the green light and the blue light may form a cell group 25 as shown in FIG. 5. In this instance, the metal bus electrodes 22*c* are connected to the pair transparent electrodes 22*b* of the cell group 25 through the connecting portions 22*h* at the four corners of the pair of transparent electrodes 22*b*. The cell group 25 increases a margin of the pattern, and is preferable for a high-resolution plasma display panel.

When the discharge cells 24 are fired, the discharge first occurs over the discharge gap 22*d*, and is spread toward the bus electrodes 22*c*. However, the slits 22*g* set a limit on the discharging area, and the discharge does not reach the bus electrodes 22*c*. In other words, the discharge does not take place through the porous dielectric layer 22*f* under the bus electrode 22*c*. For this reason, the transparent electrodes 22*b* are discharged through the rectangular openings 22*j*, and the discharge limited within the rectangular openings 22*j* increases the luminous intensity.

Moreover, the discharge cells 24 are prevented from the undesirable recombination between ion and electron, because the discharge is never spread under the porous dielectric layer 22*f*. For this reason, the luminous efficiency is improved.

The discharge does not take place under the bus electrodes 22*c*, and the bus electrodes 22*c* are less damaged.

On the other hand, the porous dielectric material makes the dielectric layer 22*f* a fine pattern. The porous dielectric material has a low dielectric constant, and allows the manufacturer to make the dielectric layer 22*f* thin. The thin porous dielectric layer 22*f* hardly crumbles during the sintering. Moreover, the porous dielectric material evacuates gas from the dielectric layer 22*f* during the sintering, and the reflow is not required. For this reason, the manufacturer can pattern the porous dielectric material into a fine pattern. As a result, the manufacturer can miniaturize the discharge cells 24 at good reproducibility.

Second Embodiment

Figure 6:
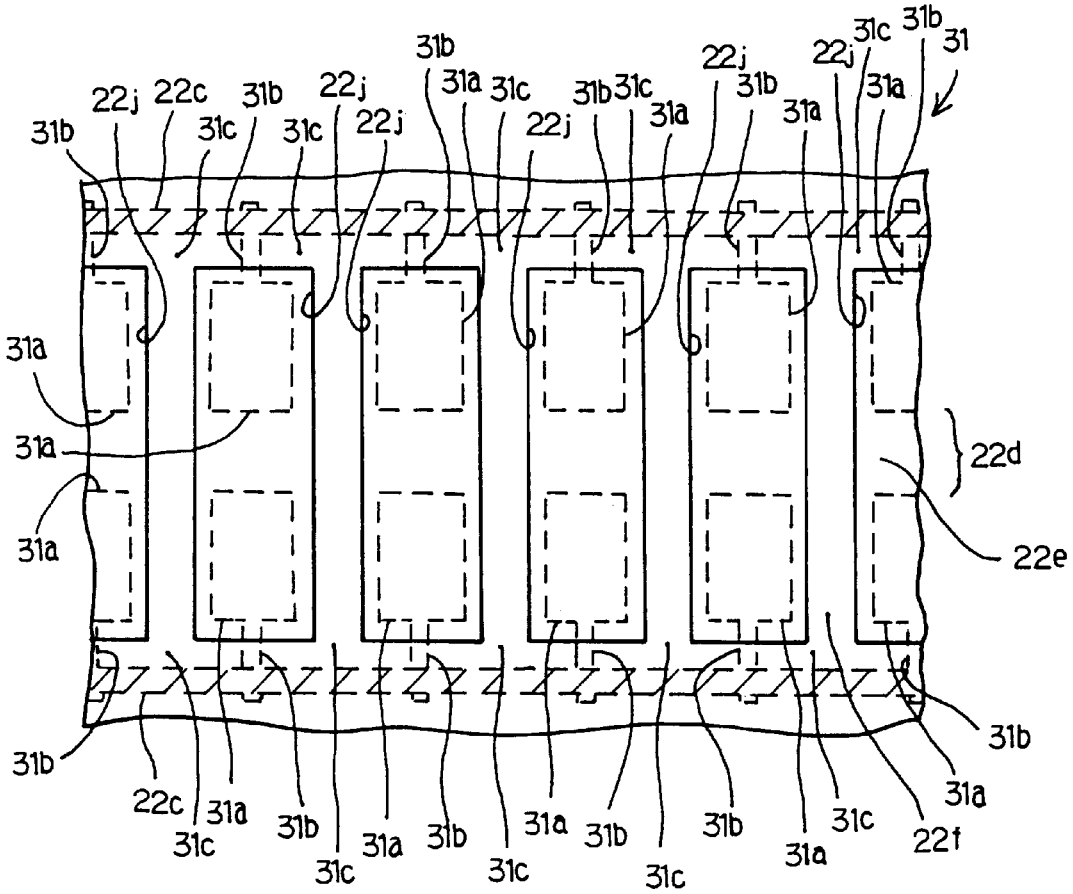
FIG. 6 is a bottom view showing the layout of transparent electrodes and bus electrodes forming parts of another surface discharge alternating current plasma discharge panel according to the present invention.

Turning to FIG. 6 of the drawings, a front substrate structure 31 forms a part of a surface discharge alternating current plasma display unit embodying the present invention. The front substrate structure 31 is assembled with a back substrate structure (not shown) corresponding to the back substrate structure 21, and discharge gas is sealed therebetween.

The front substrate structure 31 is different from the front substrate structure 22 in the configuration of transparent electrodes 31*a*, and the other component parts are labeled with the same references designating corresponding parts of the front substrate structure 22 without detailed description for the sake of simplicity.

The transparent electrodes 31*a* have rectangular configuration, and are connected through connecting portions 31*b* to the bus electrodes 22*c*. The transparent electrodes 31*a* are arranged in rows, and the rows of transparent electrodes 22*c* are electrically connected to the bus electrodes 31*a*. The discharge gap 22*d* spaces the transparent electrodes 31*a* in one row from the transparent electrodes 31*a* in the adjacent row, and discharge takes place between the row of transparent electrodes 31*a* and the adjacent row of transparent electrodes 31*a*. Thus, the transparent electrodes 31*a* in one row are paired with the transparent electrodes 31*a* in the adjacent row.

The transparent electrodes 31*a* paired with one another are located over the rectangular opening 22*j*, and the periphery of the rectangular transparent electrode 31*a* is spaced from the periphery of the rectangular opening 22*j* by 10 microns to 80 microns. The gap between the periphery of the transparent electrode 31*a* and the periphery of the opening 22*j* is preferably 50 microns.

The connecting portions 31*b* ranges from 10 microns to 80 microns wide, and the width is preferably of the order of 40 microns. Thus, the connecting portions 31*b* are narrower than the rectangular transparent electrodes 31*a*, and gap 31*c* occurs between the adjacent connecting portions 31*b*. The gap serves a similar function as that of to the slit 22*g*, and does not allow the discharge between the transparent electrodes 31*a* to exceed thereover. The connecting portions 31*b*, the bus electrodes 22*c* and the rectangular transparent electrodes 31*a* are covered with the transparent dielectric layer 22*e*, and the porous dielectric layer 22*f* covers the transparent dielectric layer 22*e* except for the areas under the rectangular transparent electrodes 31*a*.

The gaps 31*c* do not allow the discharge to reach the areas under the bus electrodes 22*c*, and achieve high luminous intensity and high luminous efficiency. The porous dielectric layer 22*f* achieves the advantages similar to the first embodiment.

Third Embodiment

Figure 7:
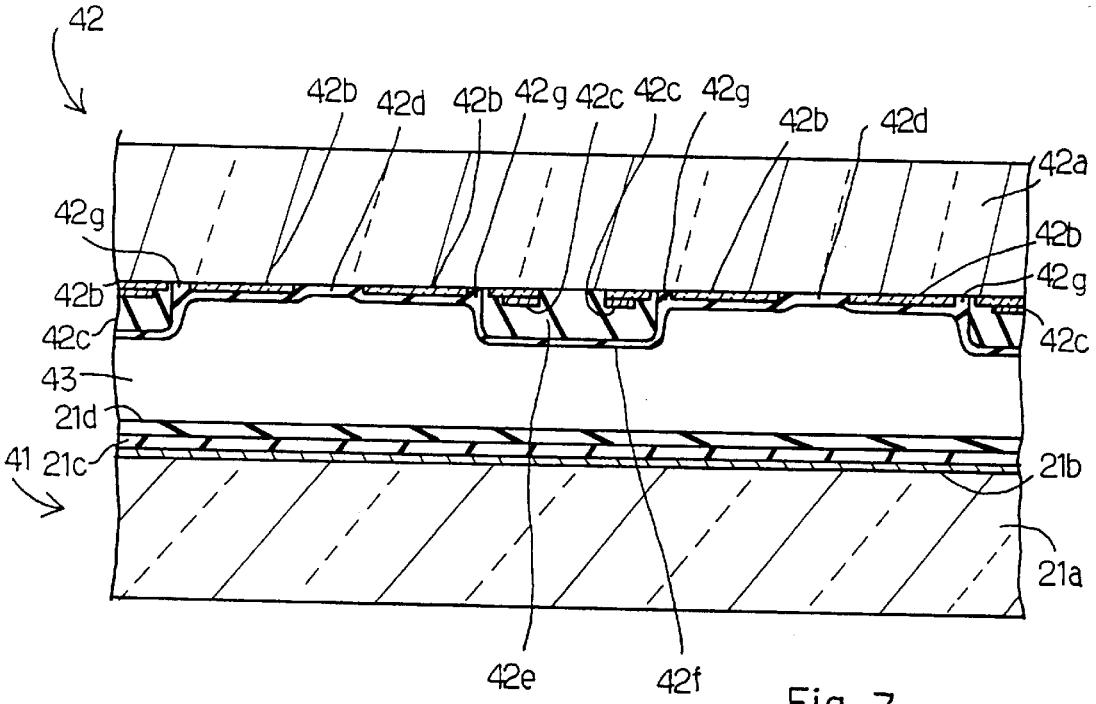
FIG. 7 is a cross sectional view showing the structure of yet another surface discharge alternating current plasma discharge panel according to the present invention.

Turning to FIG. 7 of the drawings, yet another surface discharge alternating current plasma discharge panel embodying the present invention largely comprises a back substrate structure 41, a front substrate structure 42 and discharge gas 43 sealed therebetween. The back substrate structure 41 is fabricated similar to the prior art surface discharge alternating current plasma discharge panel.

Figure 1:
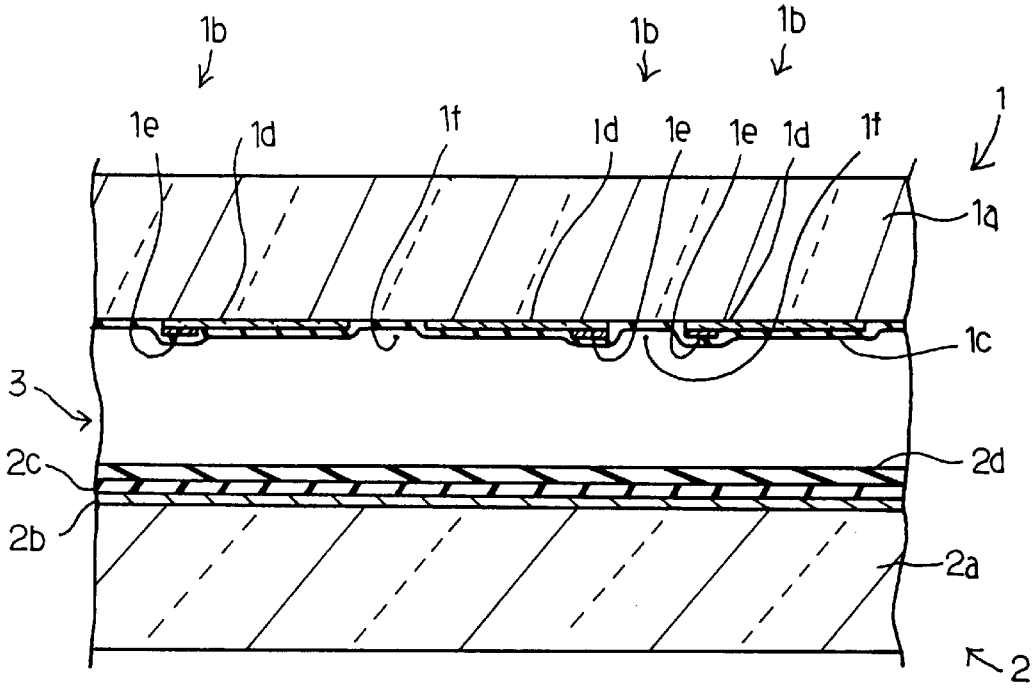
Fig. 1 PRIOR ART
FIG. 1 is a cross sectional view showing the structure of the prior art reflecting type alternating current plasma display panel.
Figure 2:
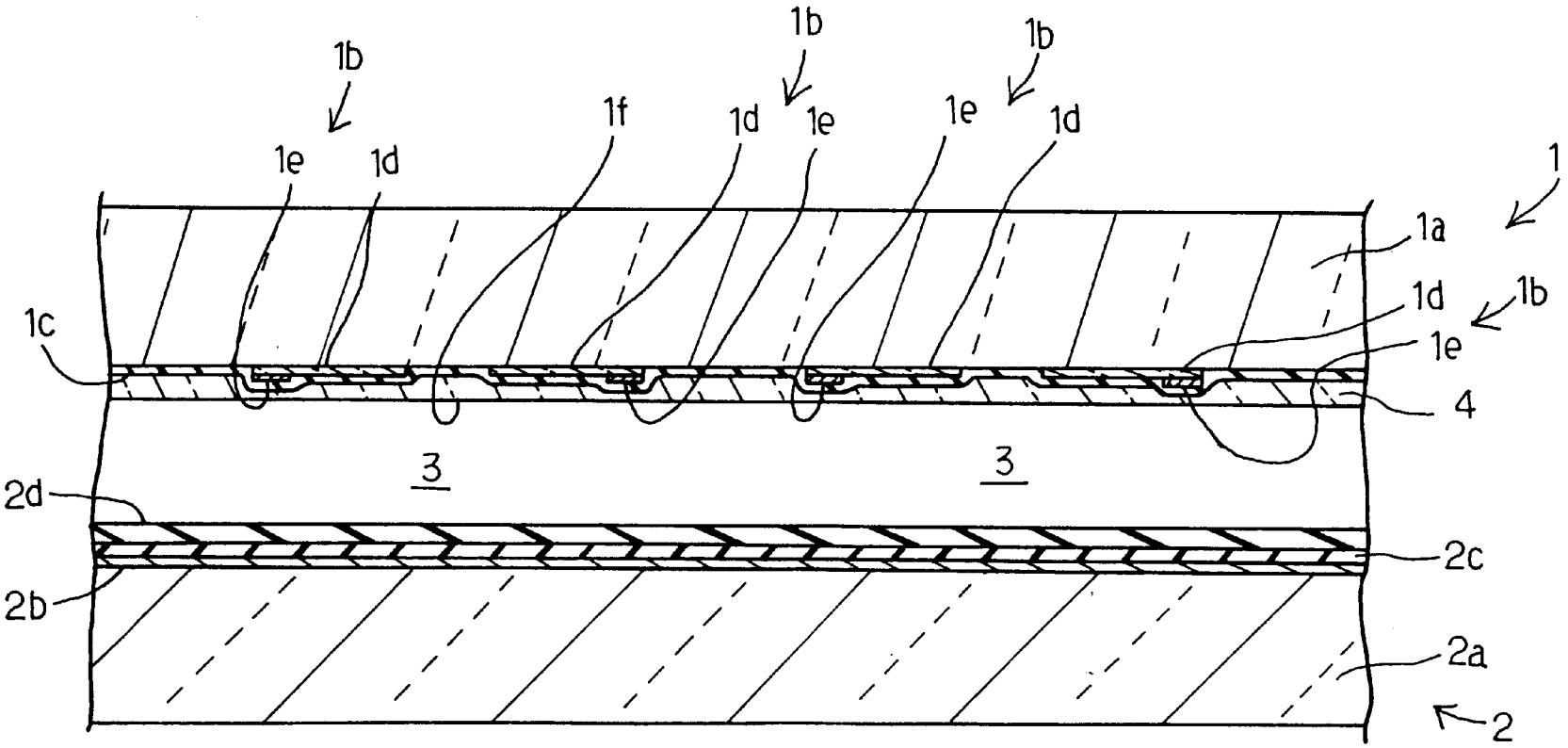
Fig. 2 PRIOR ART
FIG. 2 is a cross sectional view showing the structure of the prior art surface discharge alternating current full-color plasma display panel.

The back substrate structure 41 is similar in structure to the back substrate structure 21, and component parts of the back substrate structure 41 are labeled with the same references as those of the back substrate structure 21. The back substrate structure 41 is fabricated through the process described in connection with the prior art shown in FIG. 1.

The front substrate structure 42 is similar to the front substrate structure 22, and includes a glass substrate 42*a*, transparent electrodes 42*b* and bus electrodes 42*c*. Slits 42*g* are formed in the transparent electrodes 42*b*, and the bus electrodes 42*c* are electrically connected to the transparent electrodes 42*b* through connecting portions as similar to the first embodiment. The adjacent two transparent electrodes 42*b* are paired with each other, and discharge gap 42*d* occurs therebetween.

The front substrate structure 42 further includes a porous insulating layer 42*e* and a transparent dielectric layer 42*f*. The bus electrodes 42*c* and the connecting portions are covered with the porous insulating layer 42*e*, and the transparent dielectric layer 42*f* covers the insulating layer 42*e* and the transparent electrodes 42*b*. The porous insulating layer 42*e* is formed similar to the porous dielectric layer 22*f*.

The transparent dielectric layer 42*f* is formed as follows. Low-melting point glass paste is screen printed over the transparent electrodes 42*b* and the porous insulating layer 42*e*, and is sintered at 570 degrees in centigrade. The transparent dielectric layer 42*f* is reflowed during the sintering. The transparent dielectric layer 42*f* is 25 microns thick, and bubbles are not left in the transparent dielectric layer 42*f*. The porous insulating layer 42*e* is formed of low-melting point lead glass, which has a softening temperature equal to or at least 30 degrees lower than that of the transparent dielectric layer 42*f*.

The slits 42*g* achieve high luminous intensity and high luminous efficiency. The transparent dielectric layer 42*f* and the slits 42*g* allow the manufacturer to make the transparent dielectric layer 42*f* thin. In fact, even though the transparent dielectric layer 42*f* is of the order of 5 microns, the surface discharge takes place only under the transparent electrodes 42*b*, and the surface discharge is not spread under the bus electrodes 42*c*. The present inventors confirmed that the porous insulating layer 42*e* and the transparent dielectric layer 42*f* improve the luminous efficiency by 20 percent to 40 percent over the prior art surface discharge plasma display panel with the thick portion.

As described hereinbefore, the transparent dielectric layer 42*f* is formed through screen printing, and the screen printing makes the peripheral portion of the transparent dielectric layer 42*f* under the slits 42*g* two or three times thicker than the central portion under the discharge gap 42*d*. For this reason, the luminous intensity of the peripheral portion is much smaller than that of the central portion, and the concentration of the surface discharge improves the luminous efficiency by 5 percent to 10 percent.

Fourth Embodiment

Figure 8:
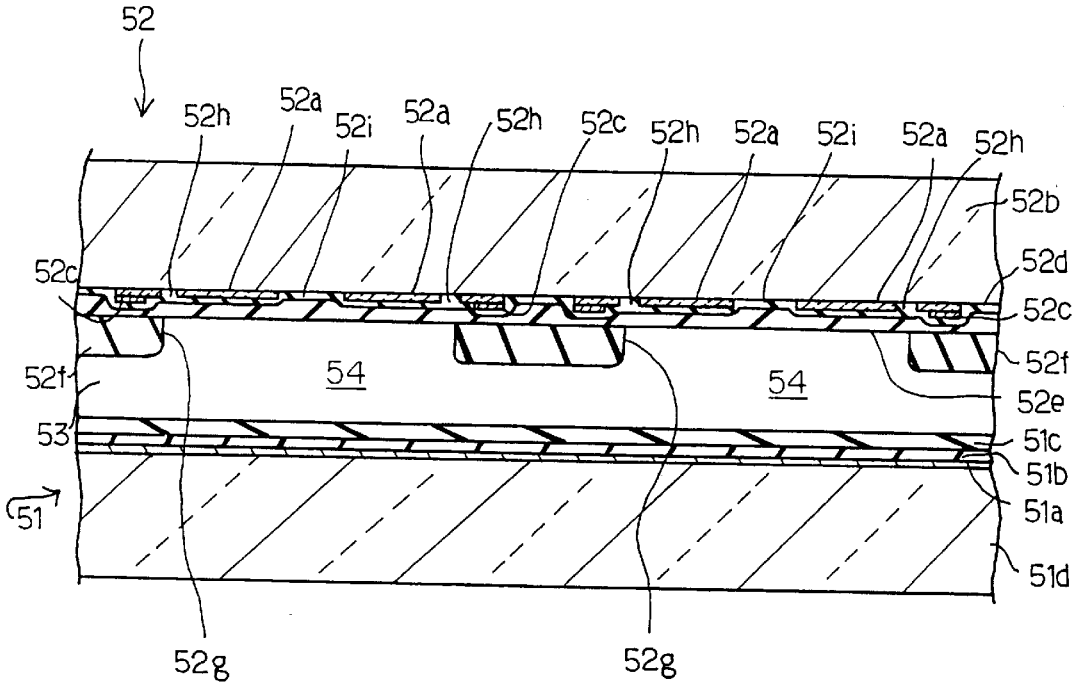
FIG. 8 is a cross sectional view showing the structure of still another surface discharge alternating current plasma discharge panel according to the present invention.

Turning to FIG. 8 of the drawings, still another surface discharge alternating current plasma display panel embodying the present invention largely comprises a back substrate structure 51, a front substrate structure 52 and discharge gas 53 sealed therebetween.

The back substrate structure 51 has data electrodes 51*a*, a white dielectric layer 51*b*, partition walls (not shown) and a phosphor layer 51*c* on a glass substrate 51*d*. The data electrodes 51*a* and transparent electrodes 52*a* define discharge cells 54 selectively assigned to red light, green light and blue light. The partition walls are arranged at 350 microns pitch between the data electrodes 51*a*, and are 80 microns wide.

The front substrate structure 52 includes a transparent glass substrate 52*b*, the transparent electrodes 52*a*, metal bus electrodes 52*c* laminated on the lower surfaces of the transparent electrodes 52*a* and a color filter 52*d* covering the transparent electrodes 52*a* and the metal bus electrodes 52*c*. The color filter 52*d* is colored in the three primary colors as follows.

First, red pigment powder such as iron oxide is mixed with binder and solvent so as to obtain red paste. The red paste is screen printed over the transparent electrodes 52*a* and the metal bus electrodes 52*c*, and forms red paste stripes of 390 microns wide at 1.05 millimeter pitch. The red paste stripes are dried at 150 degrees in centigrade, and the solvent is vaporized.

Subsequently, green pigment powder such as cobalt oxide, chromium oxide and aluminum oxide is mixed with binder and solvent, and green paste is obtained. The green paste is screen printed so as to form green paste stripes spaced in parallel from the red stripes by 350 microns, and the green paste stripes are dried.

Finally, blue pigment powder such as cobalt oxide and aluminum oxide is mixed with binder and solvent, and the blue paste is screen printed as similar to the green paste. The blue paste stripes are also dried.

The red paste stripes, the green paste stripes and the blue paste stripes are sintered at 520 degrees in centigrade, and the red stripes, the green stripes and the blue stripes form the color filter 52*d*. The red stripes, the green strips and the blue stripes are aligned with red areas, green areas and blue areas of the phosphor layer 51*c*. The red stripes, the green strips and the blue stripes are 2 microns thick. The red pigment powder, the green pigment powder and the blue pigment powder are 0.01 micron to 0.05 microns in average diameter, and the red/green/blue strips are highly dense.

When external light is incident upon the color filter 52*d*, the color filter reflects the incident light, and the screen is colored in light aquamarine. If yellow inorganic pigment or brown inorganic pigment is mixed into the porous insulating layer 52*f*, the reflection becomes close to achromatic color. On the other hand, if black inorganic pigment is mixed into the porous insulating layer 52*f*, the black porous insulating layer 52*f* absorbs the external light, and makes the contrast clear.

The front substrate structure 52 further includes a transparent dielectric layer 52*e* laminated on the color filter 52*d*. Low-melting point glass paste is screen printed over the color filter 52*d*, and is sintered at 570 degrees in centigrade so as to form the transparent dielectric layer 52*e* of 25 microns thick. The transparent dielectric layer 52*e* is reflowed during the sintering, and is smooth without bubbles.

The front substrate structure 52 further includes a porous insulating layer 52*f* formed on the transparent dielectric layer 52*e* under the metal bus electrodes 52*c* and connecting portions (not shown). The porous insulating layer 52*f* is formed similar to the porous dielectric layer 22*f*, and has rectangular openings 52*g*. Though not shown in FIG. 8, the transparent electrodes 52*a* are connected to the metal bus electrodes 52*c* through the connecting portions, and slits 52*h* occur between the connecting portions.

Magnesium oxide (not shown) is deposited over the porous insulating layer 52*f* and the transparent dielectric layer 52*e*, and the front substrate structure 52 is assembled with the back substrate structure 51. Discharge gas is sealed in gap between the front substrate structure 52 and the back substrate structure 51.

Figure 9:
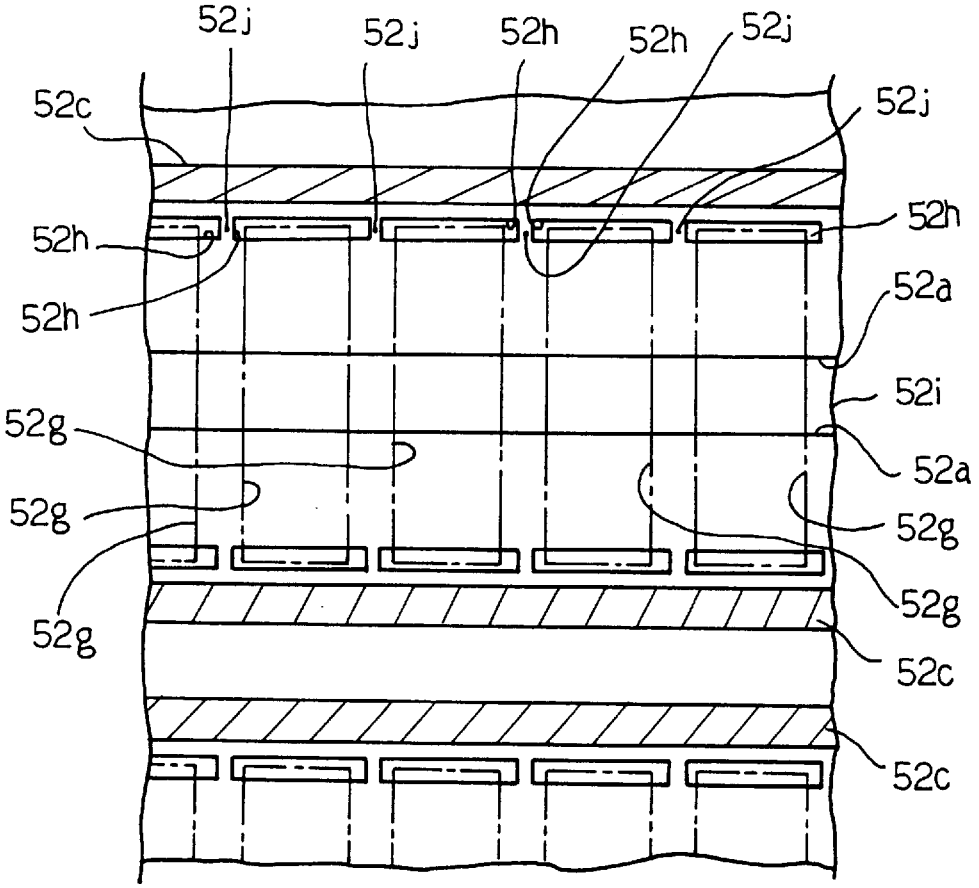
FIG. 9 is a bottom view showing slits formed in transparent electrodes incorporated in the surface discharge alternating current plasma display panel shown in FIG. 8.

FIG. 9 illustrates the slit pattern formed in the transparent electrodes 52*a* opposed to each other by discharge gap 52I, and the metal bus electrodes 52*c* are hatched so as to be easily distinguished from the transparent electrodes 52*a*. The slits 52*h* are located over both ends of each rectangular opening 52*g*, and the connecting portion 52*j* is formed between two adjacent slits 52*h*. The slits 52*h* are 10 microns to 80 microns wide, and the connecting portions 52*j* are perfectly covered with the porous insulating layer 52*f*. The porous insulating layer 52*f* covers the periphery of each discharge cell 54. Each discharge cell 54 has a pair of transparent electrodes 52*a*, and the pair of transparent electrodes 52*a* is connected to the metal bus electrodes 52*c* through the connecting portions 52*j* at the four corners of the pair.

Figure 10:
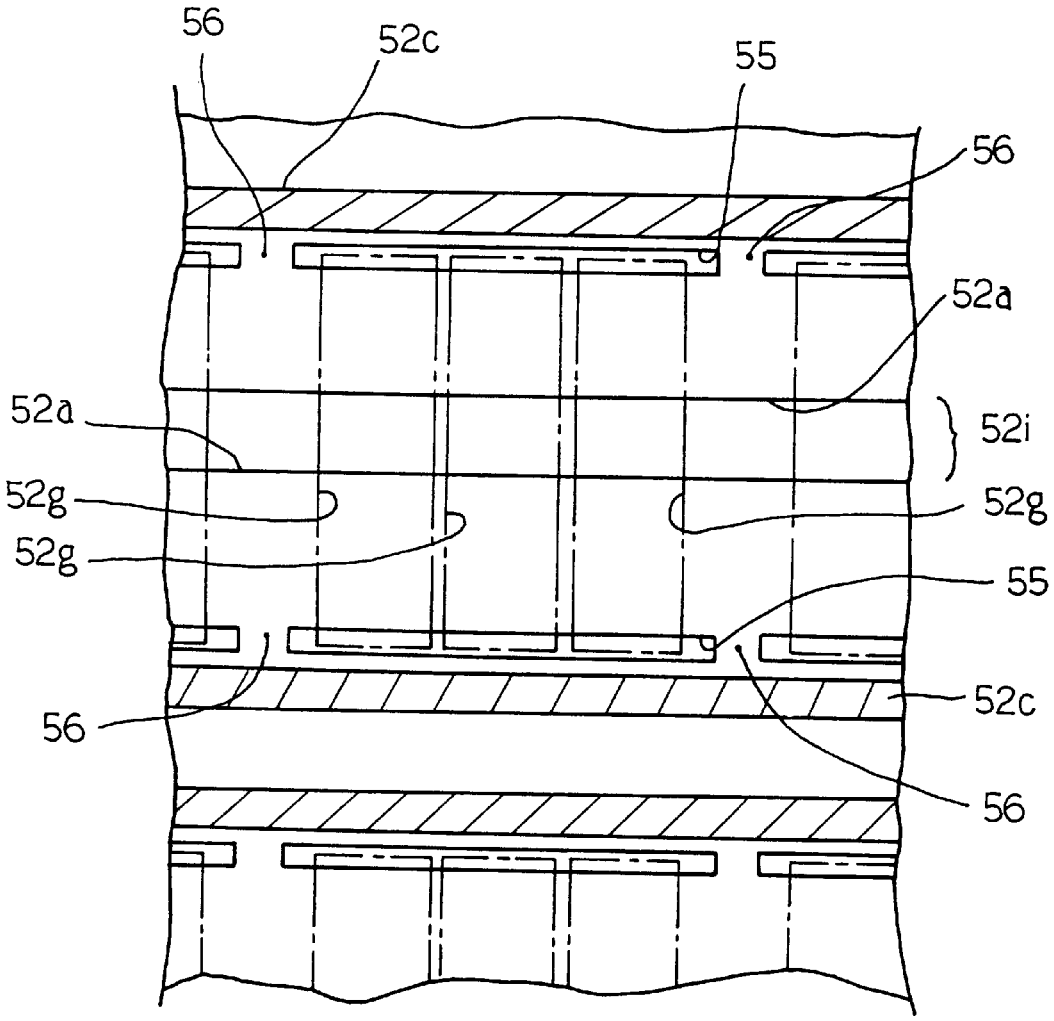
FIG. 10 is a bottom view showing a modification of the slit pattern.

The discharge cells 54 for the primary three colors may form a discharge cell group as shown in FIG. 10. In this instance, the discharge cell group is formed between a pair of slits 55, and electric current is supplied from the metal bus electrodes 52*c* through connecting portions 56 at the four corners of the discharge cell group. The slits 55 are so wide that the margin is increased.

The surface discharge alternating current plasma display panel implementing the fourth embodiment achieves all the advantages of the first embodiment.

Fifth Embodiment

Figure 11:
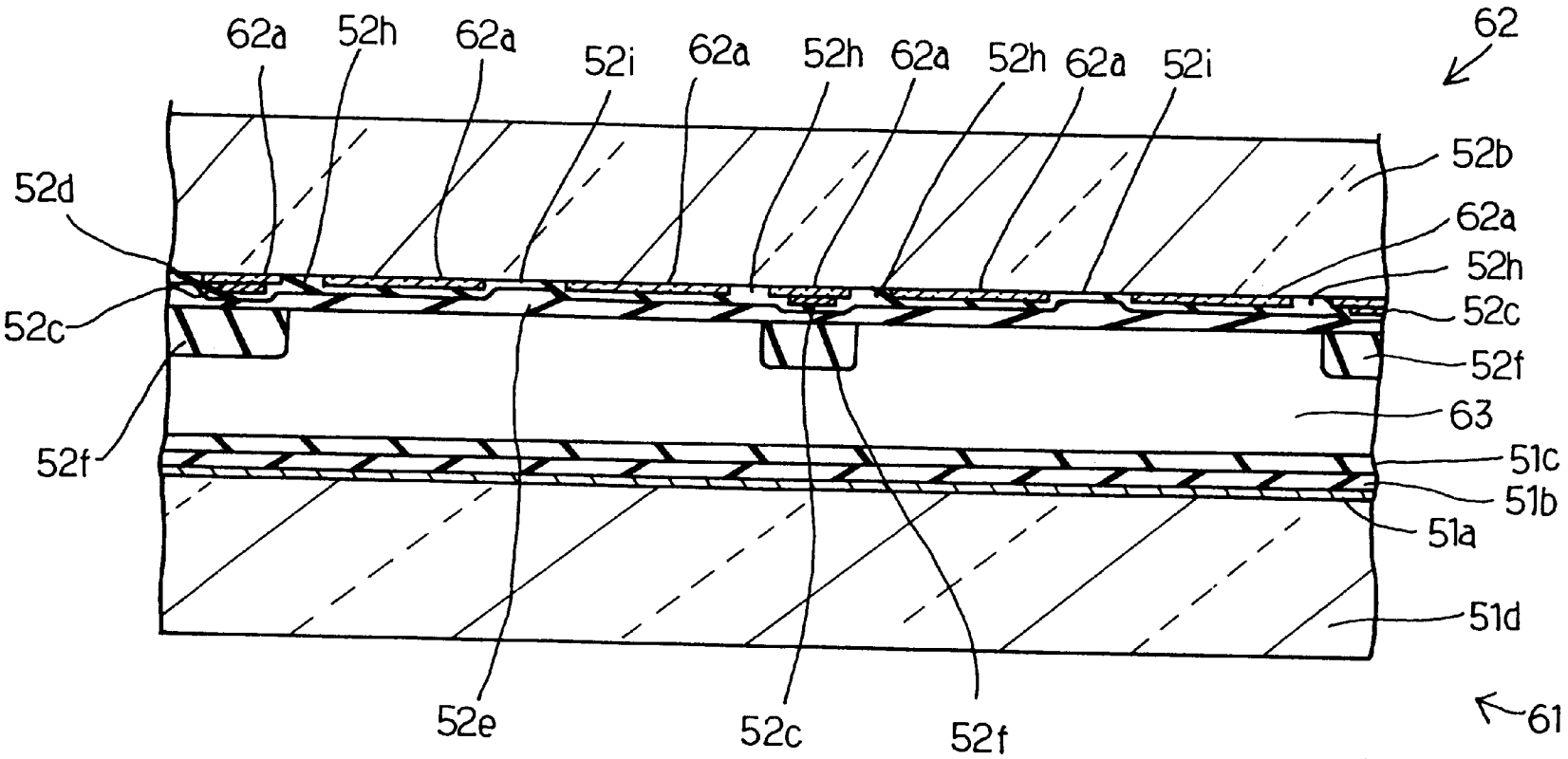
FIG. 11 is a cross sectional view showing the structure of another surface discharge alternating current plasma display panel according to the present invention.

Turning to FIG. 11 of the drawings, another surface discharge alternating current plasma display panel embodying the present invention largely comprises a back substrate structure 61, a front substrate structure 62 and discharging gas 63 sealed therebetween. The surface discharge alternating current plasma display panel implementing the fifth embodiment is similar to the fourth embodiment except for the pattern of transparent electrodes 62*a*. For this reason, the other component parts are labeled with the same references designating corresponding parts of the fourth embodiment for the sake of simplicity.

The transparent electrodes 22*b*, 42*b* and 52*a* selectively serve as a scanning electrode and a sustain electrode, and are arranged in such an order that the scanning electrode is alternated with the sustain electrode, i.e., the scanning electrode, the sustain electrode, the scanning electrode, the sustain electrode. However, the transparent electrodes 62*a* are arranged such that the sustain electrode is disposed between the scanning electrodes, and the metal bus electrode 52*c* is laminated on the sustain electrode. As a result, the discharge cells are miniaturized relative to the fourth embodiment.

Sixth Embodiment

Figure 12:
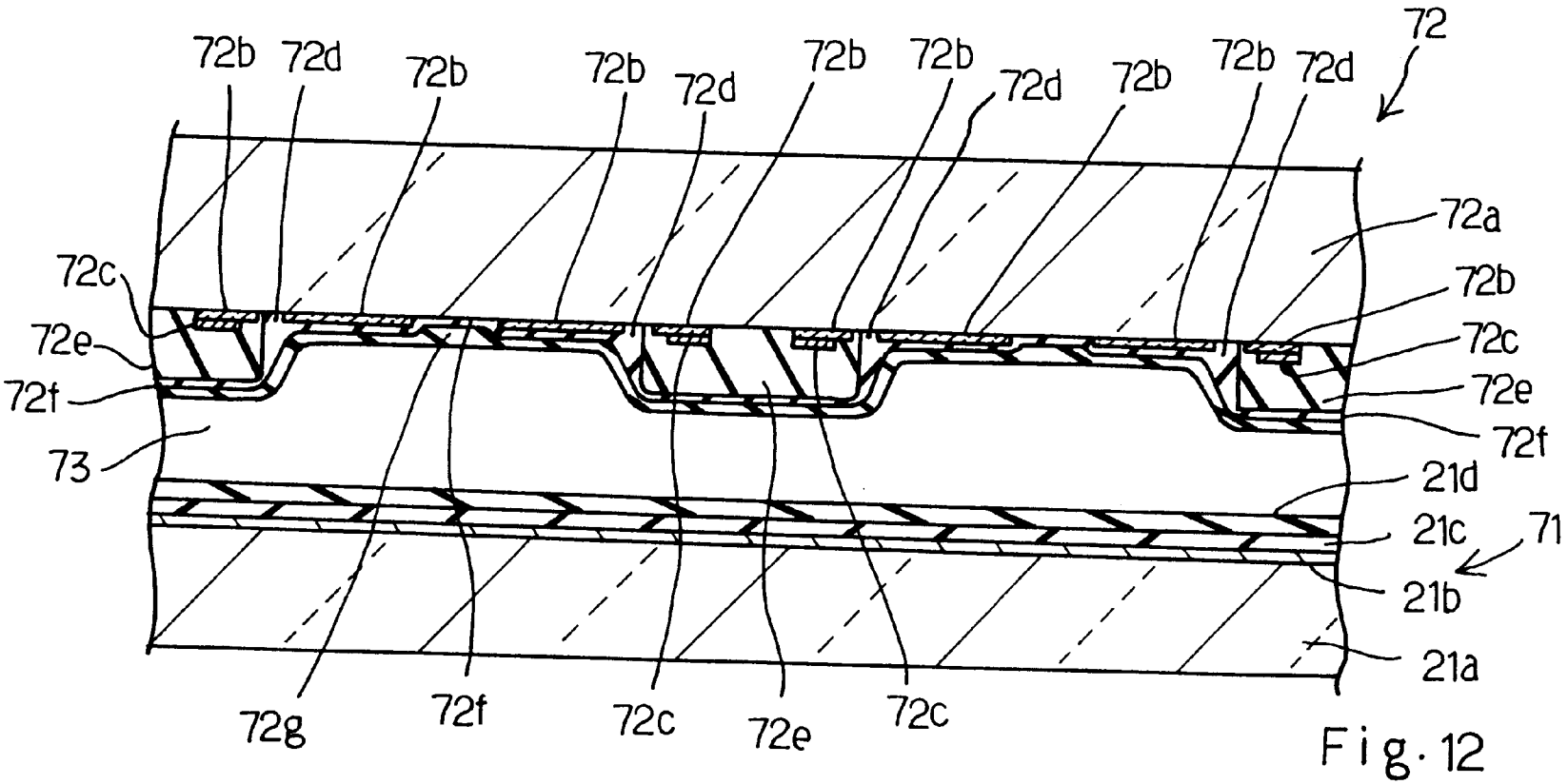
FIG. 12 is a cross sectional view showing the structure of another surface discharge alternating current plasma display panel according to the present invention.

FIG. 12 illustrates another surface discharge alternating current plasma display panel embodying the present invention. The surface discharge alternating current plasma discharge panel largely comprises a back substrate structure 71, a front substrate structure 72 and discharge gas sealed therebetween. The back substrate structure 71 is similar to the above described embodiments, and component parts are labeled with the same references designating corresponding parts of the first embodiment without detailed description.

The front substrate structure 72 includes a transparent glass substrate 72*a*, transparent electrodes 72*b* and metal bus electrodes 72*c*, and the transparent electrodes 72*b* and the metal bus electrodes 72*c* are formed as similar to those of the first embodiment. Slits 72*d* are formed between connecting portions (not shown in FIG. 12), and the metal bus electrodes 72*c* supply electric current through the connecting portions to the transparent electrodes 72*b*.

The front substrate structure 72 further includes a porous insulating layer 72*e* covering the metal bus electrodes 72*c* and the connecting portions, a color filter layer 72*f* covering the porous insulating layer 72*e* and the transparent electrodes 72*b* and a transparent dielectric layer 72*g* laminated on the color filter layer 72*f*. The porous insulating layer 72*e*, the color filter layer 72*f* and the transparent dielectric layer 72*g* are formed as follows.

Firstly, insulating paste is prepared. Insulating powder such as aluminum oxide and magnesium oxide and low-melting point lead glass powder are essential components of the insulating paste. The insulating powder and the low-melting point lead glass powder are mixed with binder and solvent so as to obtain the insulating paste. The insulating paste is screen printed in such a manner as to encircle discharge cells and cover the bus electrodes 72*c*.

Subsequently, a red pattern, a green pattern and a blue pattern are successively screen printed in such a manner as to be aligned with the primary three colors radiated from the phosphor layer 21*d*. In detail, fine red pigment powder such as iron oxide is mixed with binder and solvent so as to obtain red paste. The red paste is screen printed over the transparent electrodes 72*b* and the porous insulating layer 72*e*, and forms red paste stripes of 390 microns wide at 1.05 millimeter pitch. The red paste stripes are dried at 150 degrees in centigrade, and the solvent is vaporized.

Subsequently, fine green pigment powder such as cobalt oxide, chromium oxide and aluminum oxide is mixed with binder and solvent, and green paste is obtained. The green paste is screen printed so as to form green paste stripes spaced in parallel from the red stripes by 350 microns, and the green paste stripes are dried.

Finally, fine blue pigment powder such as cobalt oxide and aluminum oxide is mixed with binder and solvent, and the blue paste is screen printed as similar to the green paste. The blue paste stripes are also dried.

The red paste stripes, the green paste stripes and the blue paste stripes are sintered at 520 degrees in centigrade, and the red stripes, the green stripes and the blue stripes form the color filter layer 72*f*. The red stripes, the green strips and the blue stripes are respectively aligned with red areas, green areas and blue areas of the phosphor layer 21*d*. The red stripes, the green strips and the blue stripes are 2 microns thick. The red pigment powder, the green pigment powder and the blue pigment powder are 0.01 micron to 0.05 microns in average diameter, and the red/green/blue strips are high dense.

Low-melting point glass paste is screen printed over the color filter layer 72*f*, and is sintered at 570 degrees in centigrade so as to form the transparent dielectric layer 72*g*. The transparent dielectric layer 72*g* is reflowed during the sintering, and becomes 25 microns thick without bubbles. The porous insulating layer 72*e* has softening point equal to or 30 degrees higher than that of the transparent dielectric layer 72*g*.

The metal bus electrodes 72*c* are directly covered with the porous insulating layer 72*e*, and the porous insulating layer 72*e* and the slits 72*d* allow the manufacturer to make the transparent dielectric layer 72*g* thin. In fact, even though the transparent dielectric layer 72*g* is of the order of 5 microns thick, the discharge does not take place under the metal bus electrodes 72*c*. As a result, the metal bus electrodes 72*c* are never damaged.

The color filter layer 72*f* and the transparent dielectric layer 72*g* are screen printed over the porous insulating layer 72*e*, and the screen printing makes the thickness under the slits 72*d* two or three times thicker than the central portion. For this reason, the high luminous intensity is achieved in the central area of the discharge cell, and the peripheral portion of the discharge cell is never discharged. This results in high contrast.

The surface discharge alternating current plasma discharge panel achieves other advantages of the first embodiment.

As will be appreciated from the foregoing description, the slits protect the bus electrodes from the surface discharge, and restrict the discharge loss. This results in that the luminous efficiency is improved by 20 percent to 40 percent. The porous insulating layer has a low dielectric constant, and allows the manufacturer to decrease the thickness of the transparent dielectric layer to half of the transparent dielectric layer of the prior art. Moreover, reflow is not required for the porous insulating layer. As a result, the front substrate structure is manufactured in good reproducibility.

In the embodiments having the color filter layer, the porous insulating layer and the slits protect the bus electrodes from the surface discharge, and the withstanding voltage against the discharge is increased from 200 volts to more than 500 volts. Thus, the plasma display panel achieves high contrast by virtue of the color filter layer, and is increased in production yield.

Although particular embodiments of the present invention have been shown and described, it will be obvious to those skilled in the art that various changes and modifications may be made without departing from the spirit and scope of the present invention.

What is claimed is:

1. A plasma display panel comprising:

a back substrate structure having a first substrate and a plurality of data electrodes formed on an inner surface of said first substrate, a front substrate structure having a second substrate, a plurality of transparent electrodes formed on an inner surface of said second substrate, a plurality of bus electrodes formed over said inner surface of said second substrate and electrically connected to said plurality of transparent electrodes so as to selectively discharge electric current from said plurality of transparent electrodes and an electrically connected stopper means integrally formed in said plurality of transparent electrodes and protecting said plurality of bus electrodes from the discharge at said plurality of transparent electrodes, wherein gas sealed between said back substrate structure and said front substrate structure is discharged for producing plasma.

2. The plasma display panel as set forth in claim 1, wherein said plurality of transparent electrodes and said plurality of bus electrodes are covered with a dielectric layer.

3. A plasma display panel comprising a back substrate structure having a first substrate and a plurality of data electrodes formed on an inner surface of said first substrate, a front substrate structure having a second substrate, a plurality of transparent electrodes formed on an inner surface of said second substrate, a plurality of bus electrodes formed over said inner surface of said second substrate and electrically connected to said plurality of transparent electrodes so as to selectively discharge electric current from said plurality of transparent electrodes, an electrically connected stopper means integrally formed in said plurality of transparent electrodes and protecting said plurality of bus electrodes from the discharge at said plurality of transparent electrodes, wherein stopper means is implemented by slits between conductive portions, and one of said plurality of transparent electrodes are connected through said conductive portions to associated one of said plurality of bus electrodes, wherein gas sealed between said back substrate structure and said front substrate structure is discharged for producing plasma.

4. The plasma display panel as set forth in claim 3, in which said one of said plurality of transparent electrodes and another of said plurality of transparent electrodes form at least one pair of surface discharge electrodes spaced from each other by a discharge gap, and said associated one of said plurality of bus electrodes and another of said plurality of bus electrodes are respectively connected through the connecting portions of the stopper means to said one of said plurality of transparent electrodes and said another of said plurality of transparent electrodes, respectively.

5. The plasma display panel as set forth in claim 4, in which at least three discharge cells are formed on a certain area of said at least one pair of surface discharge electrodes, and are assigned to red light, green light and blue light, respectively, said certain area being connected to said associated one of said plurality of bus electrodes and said another of said plurality of bus electrodes through said connecting portions at four corners of said certain area.

6. The plasma display panel as set forth in claim 4, in which at least three discharge cells respectively assigned to red light, green light and blue light are formed on said at least one pair of surface discharge electrodes, and said front substrate structure further includes a porous insulating layer covering at least said plurality of bus electrodes and parts of said stopper means.

7. The plasma display panel as set forth in claim 6, in which said porous insulating layer is colored in such a manner that reflection of external light forms an achromatic screen image.

8. The plasma display panel as set forth in claim 4, in which each of said surface discharge electrodes is implemented by a plurality of sub-electrodes spaced from one another.

9. The plasma display panel as set forth in claim 4, in which said plurality of transparent electrodes selectively serve as scanning electrodes and sustain electrodes, and each of said plurality of bus electrodes is laminated on one of said sustain electrodes shared between adjacent two of said scanning electrodes.

10. The plasma display panel as set forth in claim 3, in which said connecting portions are smaller in width than said each of said plurality of transparent electrodes.

11. The plasma display panel as set forth in claim 3, wherein said front substrate structure further includes a porous insulating layer covering at least said plurality of bus electrodes and parts of said connecting portions.

12. The plasma display panel as set forth in claim 11, in which said porous insulating layer is colored black.

13. The plasma display panel as set forth in claim 11, wherein said front substrate structure further includes a dielectric layer covering said plurality of transparent electrodes, said plurality of bus electrodes, said stopper means and said inner surface of said second substrate which is exposed between said plurality of transparent electrodes so that said porous insulating layer is held in contact with said dielectric layer.

14. The plasma display panel as set forth in claim 13, wherein said front substrate structure further includes a color filter layer inserted between said dielectric layer and the arrangement of said plurality of transparent electrodes, said plurality of bus electrodes, said stopper means and said inner surface of said second substrate which is exposed between said plurality of transparent electrodes, and said back substrate structure further includes a phosphor layer disposed over said plurality of data electrodes and having a first area radiating red light, a second area radiating green light and a third area radiating blue light, said color filter layer having a first area colored in red and aligned with said first area of said phosphor layer, a second area colored in green and aligned with said second area of said phosphor layer and a third area colored in blue and aligned with said third area of said phosphor layer.

15. The plasma display panel as set forth in claim 11, wherein said front substrate structure further includes a dielectric layer covering said plurality of transparent electrodes, said porous insulating layer, said stopper means and said inner surface of said second substrate which is exposed between said plurality of transparent electrodes.

16. The plasma display panel as set forth in claim 15, in which first portions of said dielectric layer and second portions of said dielectric layer respectively cover said stopper means and said inner surface of said second substrate, and said first portions are thicker than said second portions.

17. The plasma display panel as set forth in claim 15, in which said front substrate structure further includes a color filter layer inserted between said dielectric layer and the arrangement of said plurality of transparent electrodes, said porous insulating layer, said stopper means and said inner surface of said second substrate which is exposed between said plurality of transparent electrodes, and said back substrate structure further includes a phosphor layer disposed over said plurality of data electrodes and having a first area radiating red light, a second area radiating green light and a third area radiating blue light, said color filter layer having a first area colored in red and aligned with said first area of said phosphor layer, a second area colored in green and aligned with said second area of said phosphor layer and a third area colored in blue and aligned with said third area of said phosphor layer.

18. The plasma display panel as set forth in claim 17, in which first portions of a lamination of said color filter layer and said dielectric layer and second portions of said lamination respectively cover said stopper means and said inner surface of said second substrate, and said first portions are thicker than said second portions.

* * * * *

UNITED STATES PATENT AND TRADEMARK OFFICE

CERTIFICATE OF CORRECTION

PATENT NO. : 6,084,349
APPLICATION NO. : 09/027213
DATED : July 4, 2000
INVENTOR(S) : Mitsuo Ueoka et al.

It is certified that error appears in the above-identified patent and that said Letters Patent is hereby corrected as shown below:

At column 1, line 66, that portion of the test reading "are expected not to be formed" should read --are expected to be formed--.

Signed and Sealed this

Twenty-fifth Day of December, 2007

JON W. DUDAS
*Director of the United States Patent and Trademark Office*